US008567774B2

(12) United States Patent
Yokote et al.

(10) Patent No.: US 8,567,774 B2
(45) Date of Patent: Oct. 29, 2013

(54) BILL DEPOSIT/WITHDRAWAL MACHINE

(75) Inventors: Takamoto Yokote, Gunma (JP); Hajime Togiya, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 244 days.

(21) Appl. No.: 13/063,322

(22) PCT Filed: Jul. 5, 2010

(86) PCT No.: PCT/JP2010/061422

§ 371 (c)(1),
(2), (4) Date: Mar. 10, 2011

(87) PCT Pub. No.: WO2011/065050

PCT Pub. Date: Jun. 3, 2011

(65) Prior Publication Data

US 2012/0193190 A1 Aug. 2, 2012

(30) Foreign Application Priority Data

Nov. 30, 2009 (JP) ..... 2009-272892

(51) Int. Cl.
*B65H 1/14* (2006.01)
*G07D 9/00* (2006.01)

(52) U.S. Cl.
USPC ..... 271/3.12; 271/149

(58) Field of Classification Search
USPC ..... 271/3.12, 149; 198/624; 414/798.2
See application file for complete search history.

(56) References Cited

U.S. PATENT DOCUMENTS

| | | | | |
|---|---|---|---|---|
| 4,883,264 | A * | 11/1989 | Yoshikawa et al. | 271/110 |
| 5,098,078 | A * | 3/1992 | Nakanishi | 271/10.11 |
| 6,186,490 | B1 * | 2/2001 | Sugiura et al. | 271/10.09 |
| 6,533,261 | B2 * | 3/2003 | Katou et al. | 271/3.12 |
| 7,128,314 | B2 * | 10/2006 | Iida | 271/4.02 |
| 7,273,211 | B2 * | 9/2007 | Yanagida | 271/3.14 |
| 7,322,518 | B2 * | 1/2008 | Yokoi et al. | 235/379 |
| 7,828,133 | B2 * | 11/2010 | Kadowaki et al. | 194/206 |
| 8,033,542 | B2 * | 10/2011 | Bisone et al. | 271/179 |
| 8,096,548 | B2 * | 1/2012 | Iwami et al. | 271/119 |
| 2003/0193273 | A1 | 10/2003 | Yamashita et al. | |
| 2006/0144922 | A1 | 7/2006 | Park et al. | |
| 2008/0156614 | A1 | 7/2008 | Park et al. | |

FOREIGN PATENT DOCUMENTS

| | | | |
|---|---|---|---|
| JP | 03-276281 | A | 12/1991 |
| JP | 09-147193 | A | 6/1997 |
| JP | 2000-099795 | A | 4/2000 |
| JP | 2003-303366 | A | 10/2003 |

OTHER PUBLICATIONS

Extended European Search Report issued on Jul. 19, 2013.

* cited by examiner

*Primary Examiner* — Douglas Hess
(74) *Attorney, Agent, or Firm* — Rabin & Berdo, P.C.

(57) ABSTRACT

Provided is a means for stably accumulating the bills to be paid out to a customer. A bill press (26) has a dog-leg shape composed of a supporting face (26*a*) facing bills and an inclined face (26*b*) inclined in a direction away from the bills above the supporting face (26*a*), has two sliding pins (30) lined up along a movement direction on a side face thereof, and has a sliding groove (35) at the side of the bill press (26). A bent portion (35*a*) is provided at one end of the sliding groove (35) on the side of an accumulating tongue piece roller (28). When the bills to be paid out to a customer are accumulated in a bill deposit/withdrawal unit (10), the bill press (26) turns so that the sliding pins (30) on the side of the accumulating tongue piece roller (28) enter the bent portion (35*a*), and thereby the supporting face (26*a*) is inclined toward the accumulating tongue piece roller (28).

3 Claims, 13 Drawing Sheets

BILL DEPOSIT/WITHDRAWAL MACHINE

TECHNICAL FIELD

The present invention relates to a bill deposit/withdrawal machine that is provided in an automatic teller machine to perform processing for deposit/withdrawal of bills (banknotes).

RELATED ART

A conventional bill deposit/withdrawal machine accumulates input bills in an upright state, and includes a pickup roller that delivers the accumulated bills in a direction orthogonal to a supporting plate; a first bill press that is provided on the side of the pickup roller so as to be reciprocable in a direction orthogonal to the delivery direction of bills by the pickup roller; a second bill press that is provided on the opposite side of the pickup roller with the first bill press therebetween so as to be reciprocable in the direction orthogonal to the delivery direction while facing the first bill press; and an accumulating tongue piece roller unit that accumulates rejected bills arranged so as to protrude and retract between the first and second bill presses.

Additionally, in a case where a customer has forgotten to take rejected bills accumulated between a reject bill stopper and the second bill press, a reject bill stopper is retreated from a bottom plate on which bills are accumulated.

Also, by moving the second bill press in the direction of the first bill press, the first bill press rotates by 90 degrees and is brought into a horizontal state. As a result, the second bill press and the rejected bills pass over the first bill press. Moreover, the rejected bills are pushed against the pickup roller by the second bill press, and the rejected bills are taken in by the rotation of the pickup roller (for example, refer to Patent Document 1 (Japanese Patent Application Laid-Open (JP-A) No. 09-147193 (Paragraph "0038" to Paragraph "0030", Paragraph "0042" to Paragraph "0044", FIG. 3)).

DISCLOSURE OF INVENTION

Technical Problem

However, in the above-described conventional technique, in order to deliver the rejected bills accumulated in the bill deposit/withdrawal unit, it is necessary to provide a tilting mechanism for the first bill press, a retreating mechanism for the reject bill stopper, and the like, and the configuration of the bill deposit/withdrawal unit becomes complicated.

Additionally, when the rejected bills are pushed by the second bill press and pass over the first bill press that has rotated by 90 degrees and been brought into a horizontal state, the rejected bills may fall. For this reason, there is a problem in that poor delivery of the rejected bills may be caused.

The object of the invention is to provide a means for solving the above problems.

Solution to Problem

In order to solve the above problems, the invention provides a bill deposit/withdrawal machine comprising: a separation/delivery means that delivers bills (banknotes), that are input into a bill deposit/withdrawal unit, to a conveying path; an accumulating tongue piece roller that accumulates the bills to be paid out to a customer in the bill deposit/withdrawal unit; and a bill guide portion and a bill press that are arranged to face each other and reciprocate between the separation/delivery means and the accumulating tongue piece roller, wherein the bill press has a dog-leg shape (V-shape) composed of a supporting face facing the bills and an inclined face inclined in a direction away from the bills above the supporting face, and wherein when the bills are accumulated in the bill deposit/withdrawal unit, a turning means is provided to turn the bill press so that the supporting face of the bill press moved toward the accumulating tongue piece roller is inclined to guide the bills toward the bill guide portion.

Advantageous Effects of the Invention

Due thereto, the invention can pay out bills to a customer stably in an accumulated state, and the effect that a structure is further simplified and costs can be reduced is obtained.

BEST MODE FOR CARRYING OUT THE INVENTION

Embodiments of a bill deposit/withdrawal machine according to the invention will be described below with reference to the drawings.

Embodiment 1

Figure 1:
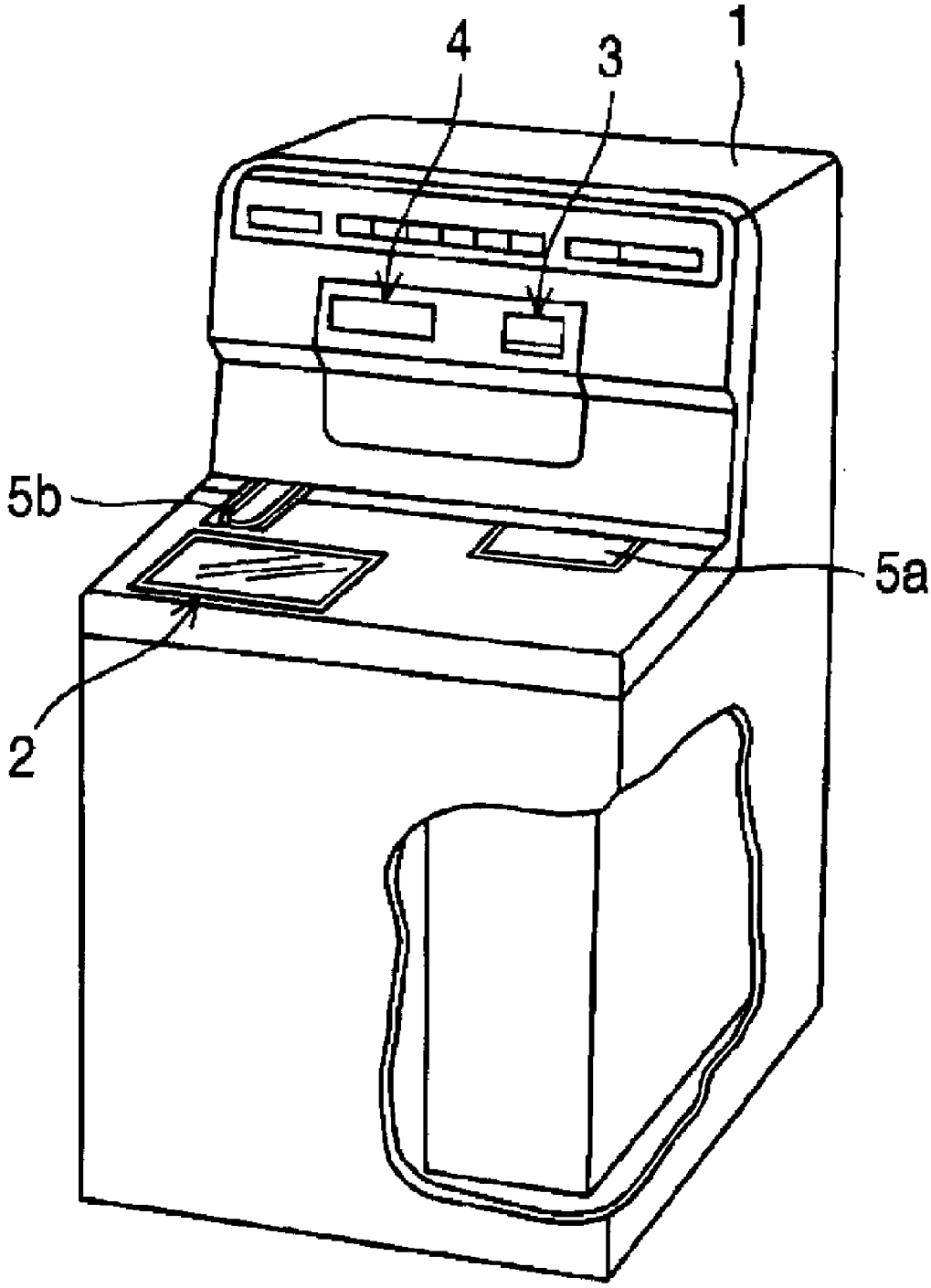
FIG. 1 is an appearance diagram showing an automatic teller machine of embodiment 1.

FIG. 1 is an appearance diagram showing an automatic teller machine of Embodiment 1.

In FIG. 1, reference numeral 1 designates an automatic teller machine serving as a bill deposit/withdrawal machine that is installed in operating branches of a financial institution, such as a bank, convenience stores, or the like, and is connected to a host computer or the like provided at the center of the financial institution via a communication line.

The automatic teller machine 1 includes a display operation unit 2, a card read/write unit 3, a bankbook handling unit 4, a cash deposit/withdrawal unit 5, and the like.

The display operation unit 2 is provided so as be exposed to the service side of the front of the automatic teller machine 1, and a display unit of a CRT display, a liquid crystal display, or the like whose display surface faces up, and an operation unit using a touch panel arranged on the display unit are used. Also, a screen on which messages that guide operation by a customer and various kinds of input keys are disposed is displayed, and the input keys are depressed with a finger from the touch panel so that not only can information defined in the input keys be input but also display or the like of the input information can be performed.

The card read/write unit 3 has the function of performing reading and writing of data from/into a magnetic stripe provided on a customer's transaction card, and a card insertion/return slot is provided on the service side.

The bankbook handling unit 4 has the function of writing bankbook information recorded on the magnetic stripe of a customer's inserted bankbook, and has the function of booking the contents of transactions or the like in the customer's bankbook. The bankbook insertion/return slot is provided on the service side.

The cash deposit/withdrawal unit 5 performs deposit/withdrawal processing of cash accompanying transactions, and is constituted by a bill handling unit handling bills and a coin handling unit handling coins. As shown in FIG. 1, a bill deposit/withdrawal port 5*a* and a coin withdrawal port 5*b* are provided on the service side.

Figure 2:
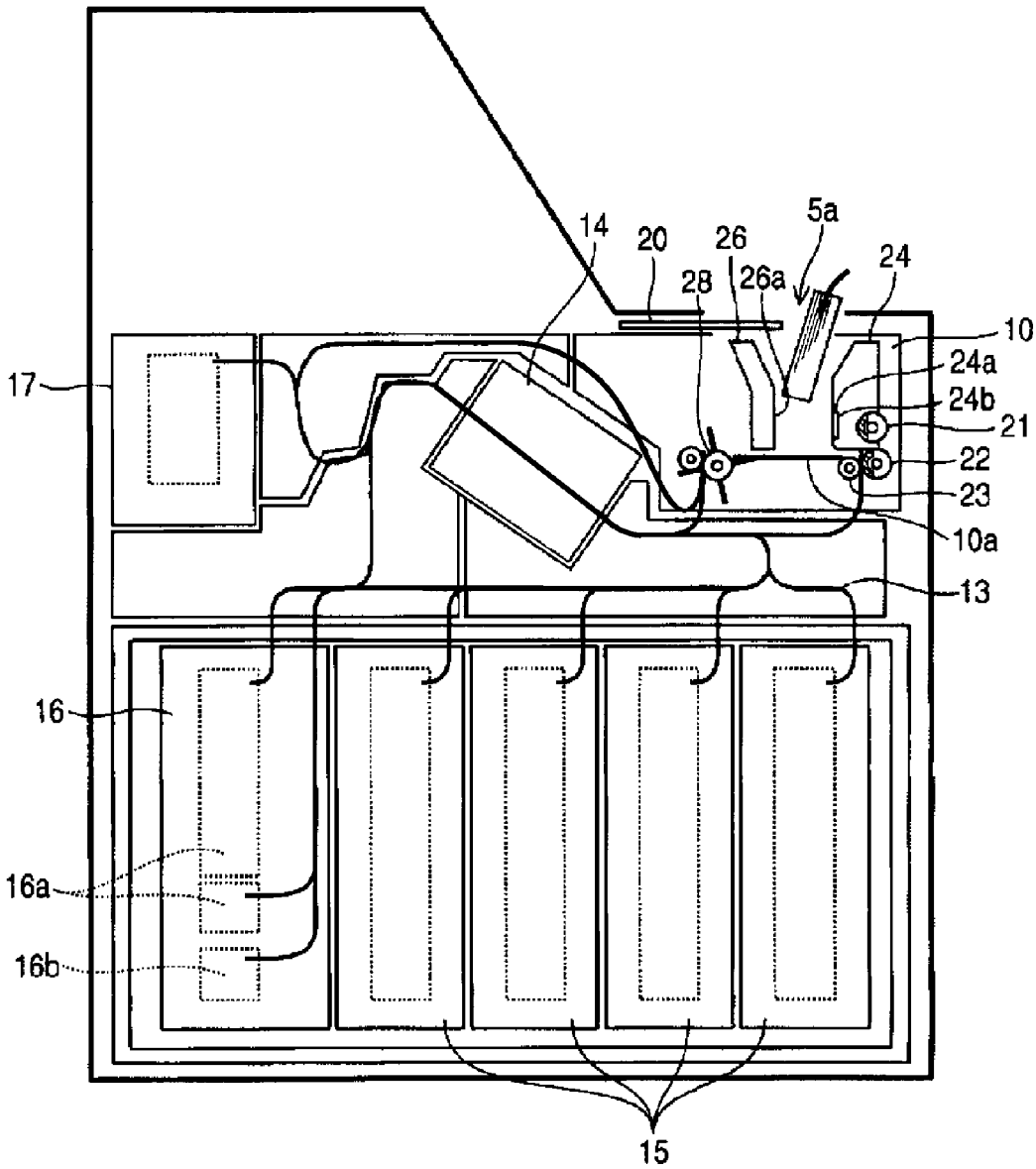
FIG. 2 is an explanatory view showing the schematic configuration of a bill handling unit.

FIG. 2 is an explanatory view showing the schematic configuration of the bill handling unit.

In FIG. 2, reference numeral 10 designates a bill deposit/withdrawal unit that has a receiving space that receives bills input through the bill deposit/withdrawal port 5*a* in an upright state. A portion of a bottom plate 10*a* of the receiving space is formed in the shape of, for example, a net, and a foreign matter reserve portion (not shown) that accumulates and reserves foreign matter, such as clips or trash, along with the bills, is provided below the net-shaped place. Also, the foreign matter input along with bills is dropped to the foreign matter reserve portion from the net of the bottom plate 10*a* so that the foreign matter does not enter a conveying path 13, as will be described below.

Reference numeral 13 designates a conveying path along which a bill is conveyed while both front and back sides of the bill are pinched by a belt pair or a roller pair, and conveys the bills delivered from the bill deposit/withdrawal unit 10. Additionally, the conveyance direction of bills is switching by providing plural blades along the conveying path.

Reference numeral 14 is a bill discrimination unit that discriminates the denomination, authenticity, state of damage, and the like of bills.

Reference numeral 15 designates a bill storage section that is composed of plural storages that store bills of predetermined denominations. Also, each storage is provided with a delivery means that delivers bills to the conveying path 13.

Reference numeral 16 is a bill recovery unit that is a constituent unit composed of a recovered bill storage 16*a* that stores bills (for example, 2000 yen or 5000 yen) not used in a cycle and withdrawal-rejected bills that are rejected at the time of withdrawal, among the bills deposited by a customer, and a forgotten bill recovery storage 16*b* that stores forgotten bills when a customer forgets to take input-rejected bills or withdrawn bills as will be described below during transaction processing of input bills, such as a deposit transaction.

Reference numeral 17 designates a temporary storage unit that temporarily stores input-rejected bills returned to a customer, for example, for the reason that the denomination of the bills cannot be discriminated, among the bills input by the customer.

Reference numeral 20 is a shutter that is arranged above the bill deposit/withdrawal unit 10, and the shutter 20 is configured so as to be reciprocable in a direction orthogonal to the delivery direction of bills by a pickup roller 21. Also, the shutter 20 opens the bill deposit/withdrawal port 5*a* during the input and withdrawal of bills during a transaction with a customer, and closes the bill deposit/withdrawal port 5*a*, for example, during take-in processing of bills.

Reference numeral 21 is a pickup roller that is arranged above the bottom plate 10*a* at a side of the bill deposit/withdrawal unit 10. Additionally, a friction member with a high coefficient of friction, such as rubber, is attached to a portion of the outer peripheral surface of the pickup roller 21 so as to facilitate the feeding of bills. Also, the pickup roller 21 delivers bills in an upright state on the bottom plate 10*a* toward the conveying path 13 shown in FIG. 2.

Reference numeral 22 is a feed roller that is arranged downstream of the pickup roller 21 in the delivery direction of bills. Additionally, a high-friction member similar to the pickup roller 21 is attached to a portion of the outer peripheral surface of the feed roller 22 so as to facilitate the feeding of bills. Also, the feed roller 22 further delivers the bills delivered by the pickup roller 21 to the conveying path 13 shown in FIG. 2.

Reference numeral 23 is a gate roller that is arranged to face the feed roller 22, and rotates along with the feed roller 22 when bills are carried into the bill deposit/withdrawal unit 10 (during carrying-in of bills). Additionally, the gate roller 23 includes a one-way rotating mechanism that is not rotated during the feeding of bills, and has the function of separating the bills delivered to between the feed roller 22 and the gate roller 23 from the bill deposit/withdrawal unit 10 one by one.

Also, as for the function of separating bills one by one, for example, plural high-friction members that have a frictional force sufficient to convey bills are arranged at a portion of the outer peripheral surface of the feed roller 22. Moreover, a ring-shaped groove portion extending along a circumferential direction is formed between adjacent high-friction members at the outer peripheral surface of the feed roller 22. Additionally, a convex portion that becomes convex along the circumferential direction is provided on the outer peripheral surface on the side of the gate roller 23. Also, the gate roller 23 and the feed roller 22 are arranged so that the convex portion of the gate roller 23 and the groove portion of the feed roller 22 face each other. Due to this, bills are separated one by one.

The pickup roller 21, the feed roller 22, and the gate roller 23 constitute a separating/delivering means that separates and delivers the bills input into the bill deposit/withdrawal unit 10 one by one.

Reference numeral 24 designates a bill guide portion that is a wall that constitutes the receiving space of bills that faces the faces of bills in the bill deposit/withdrawal unit 10 and is disposed on the pickup roller 21 side. The bill guide portion 24 is configured to be reciprocable in the direction orthogonal to the delivery direction of bills, and has a bill abutting face 24*a* that is substantially parallel to the faces of bills accumulated on the bottom plate 10*a*, and abuts on the accumulated bills.

Additionally, the bill guide portion 24 has a cutout hole 24*b* provided in a portion of the bill abutting face 24*a*, and when bills are delivered, the bill guide portion 24 moves to a position where the outer periphery of the pickup roller 21 protrudes into the receiving space from the cutout hole 24*b*.

Reference numeral 26 designates a bill press that is a dog-leg shape (V-shape) plate-like member that is disposed to face the bill guide portion 24 and that is a wall constituting the receiving space of bills so as to face the bill guide portion 24.

Additionally, the bill press 26 is configured to be reciprocable in the direction orthogonal to the delivery direction of bills by a driving mechanism (not shown). Also, the bill press 26 moves toward the pickup roller 21 side along with the bill guide portion 25 when bills are delivered, and has a function of pressing the bills to the pickup roller 21.

Reference numeral 28 designates an accumulating tongue piece roller having plural tongue pieces. Also, the accumulating tongue piece roller 28 taps the rear ends of withdrawn bills or input-rejected bills, and moves the rear ends toward the bill guide portion 24 when the bills to be paid out to a customer in withdrawal processing or the input-rejected bills in deposit processing have been conveyed to the bill deposit/withdrawal unit 10 by the conveying path 13.

Figure 3A:
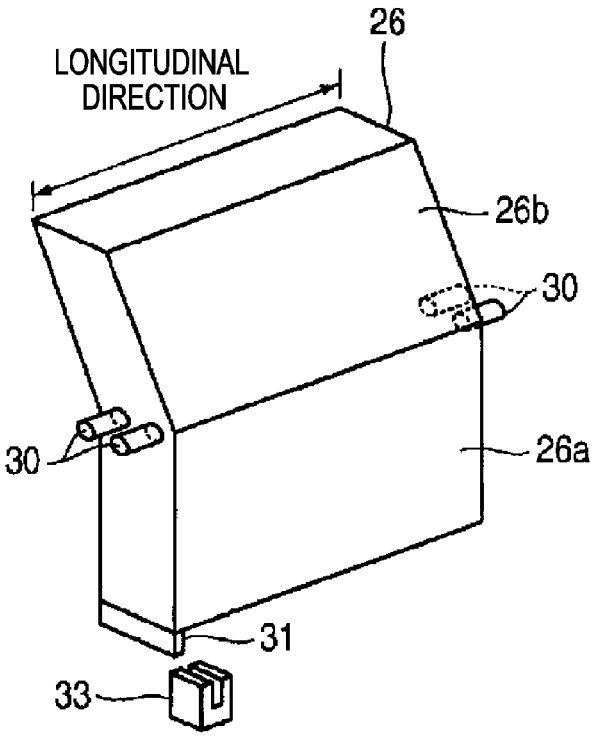
FIG. 3 is an explanatory view showing a bill press.
Figure 3B:
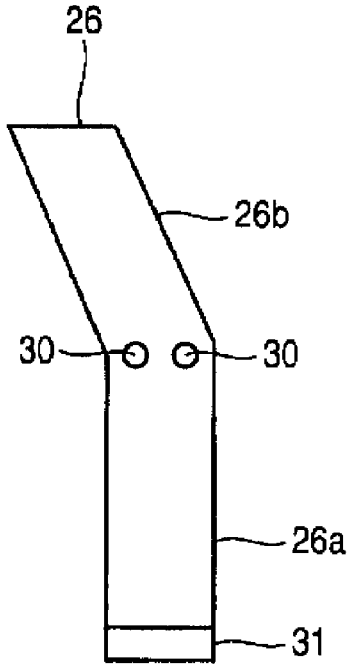

Here, FIGS. 3A and 3B are explanatory views showing the bill press, FIG. 3A is a perspective view and, and FIG. 3B is a side view.

In FIG. 3, reference numeral 30 designates sliding pins that are provided at both ends of the bill press 26 in the longitudinal direction with two at each end and are provided side by side along the movement direction of the bill press 26. Also, the sliding pins 30 are fitted into a sliding groove (not shown) that will be described below and that is provided in the frame of the bill deposit/withdrawal unit 10, and are supported by the sliding groove.

Reference numeral 31 is a detection plate that is provided at a lower end of the bill press 26.

In addition, in FIG. 3A, reference numeral 33 designates a position sensor, such as an optical position sensor, that has an opening that opens upward in the shape of the letter U and that is arranged on the movement path of the bill press 26. Also, the position sensor 33 detects the position of the bill press 26 as the bill press 26 moves and is blocked by the detection plate 31.

In FIG. 3B, reference numeral 26*a* designates a supporting face that is formed from a central portion of the above-described bill press 26 to a lower portion thereof, and reference numeral 26*b* designates an inclined face that is formed from the upper portion of the bill press to the central portion thereof.

Figure 4:
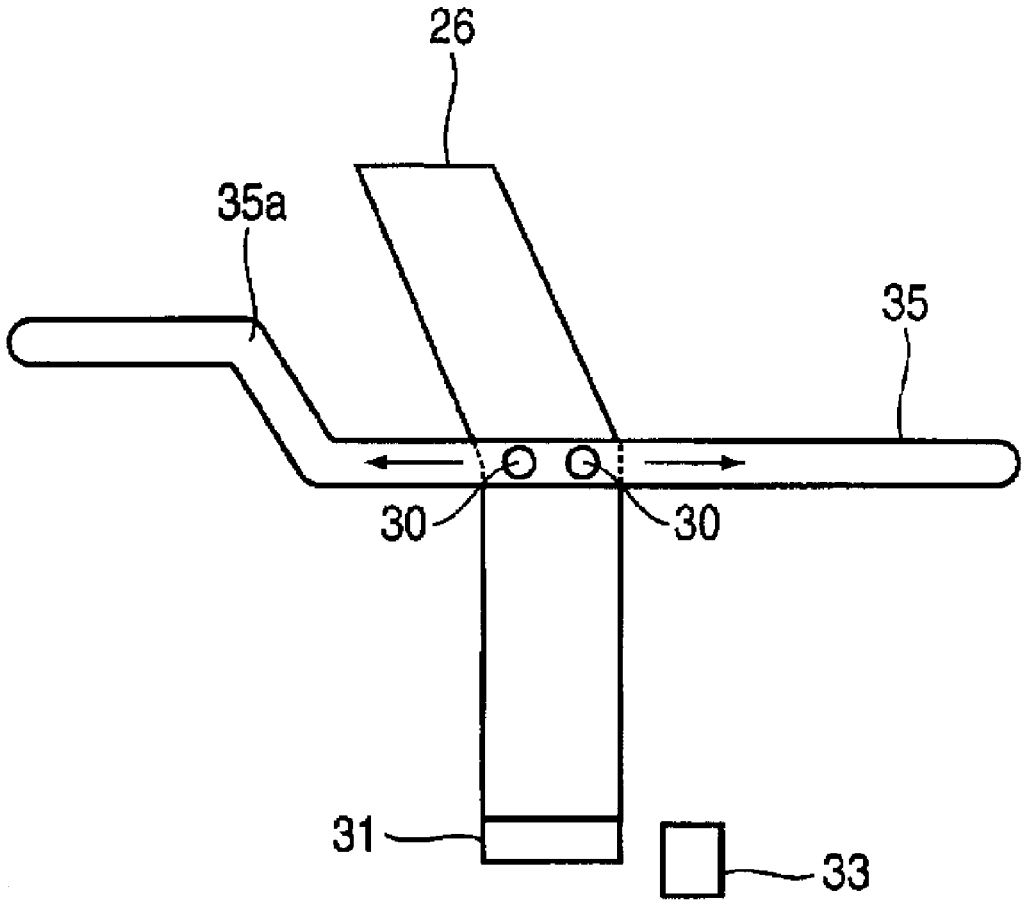
FIG. 4 is an explanatory view showing a movable guide provided at a frame.

Here, FIG. 4 is an explanatory view showing a movable guide provided in the frame.

In FIG. 4, reference numeral 35 designates a sliding groove that is formed at a side of the bill press 26 of the frame (not shown) of the bill deposit/withdrawal unit 10 as described above, and into which the sliding pin 30 is slidably fitted. Also, the sliding groove 35 supports the bill press 26 and guides movement of the bill press as the sliding pin 30 fits thereinto.

Additionally, although the sliding groove 35 is formed parallel to the bottom plate 10*a* because the bill press 26 moves, a one-step higher stepped portion is provided above the accumulating tongue piece roller 28, and a bent portion (turning means) 35*a* that inclines toward a one-step higher stepped portion from near the accumulating tongue piece roller 28 is formed.

The inclination of the bent portion 35*a* is determined so that the supporting face 26*a* of the bill press 26 is inclined toward the accumulating tongue piece roller 28 from the state of being parallel to the bill face and the bill press 26 is inclined to a state where the inclined face 26*b* of the bill press 26 faces the bill guide portion 24, when the bill press 26 moves toward the accumulating tongue piece roller 28 and the sliding pins 30 of the bill press 26 enter the bent portion 35*a*.

Figure 5:
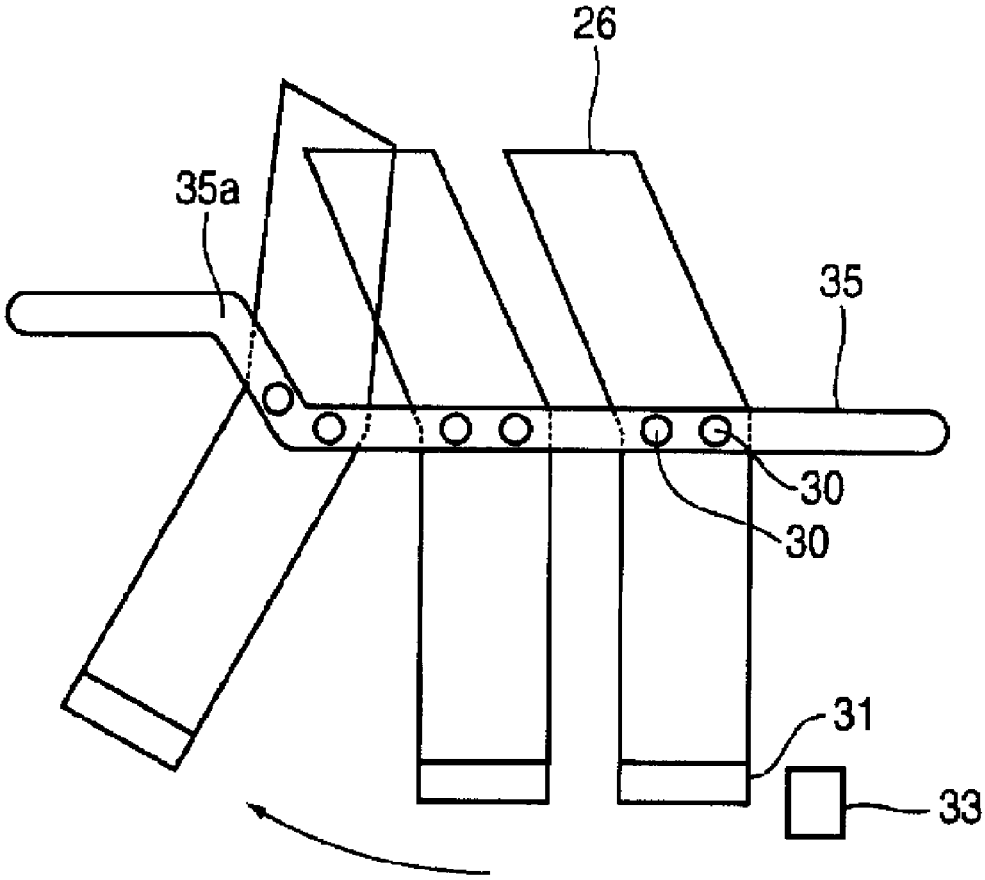
FIG. 5 is an explanatory view showing a state of the bill press that is moving.

Here, FIG. 5 is an explanatory view showing the aspect of the bill press that is moving.

The sliding pins 30 of the bill press 26 are fitted into the sliding groove 35. For this reason, the sliding pin 30 on the side near the accumulating tongue piece roller 28 enters the bent portion 35*a* by moving toward the accumulating tongue piece roller 28 along the sliding groove 35. At this time, as shown in FIG. 5, the supporting face 26*a* is inclined toward the accumulating tongue piece roller 28, and the bill press 26 turns so as to be brought into a state where the inclined face 26*b* faces the bill guide portion 24 substantially parallel thereto.

The operation of the above-described configuration will be described.

In addition, the operation of respective units as will be described below is controlled by a control unit (not shown) on the basis of a program (software) stored in a memory unit (not shown).

As shown in FIG. 2, in a case where a deposit transaction is performed, the bill guide portion 24 and the bill press 26 are arranged below the bill deposit/withdrawal port 5*a* so as to be spaced narrower than the opening of the bill deposit/withdrawal port 5*a* and to provide a predetermined gap therebetween so as to constitute the receiving space of bills of such a width that a customer's hand may enter therein.

Also, the bill deposit/withdrawal port 5*a* is opened by the opening operation of the shutter 20, and a customer inputs bills from the bill deposit/withdrawal port 5*a*.

After lapse of a predetermined time after a sensor (not shown) last detects the hand of the customer who inputs a bill, the shutter 20 operates to close.

Figure 6:
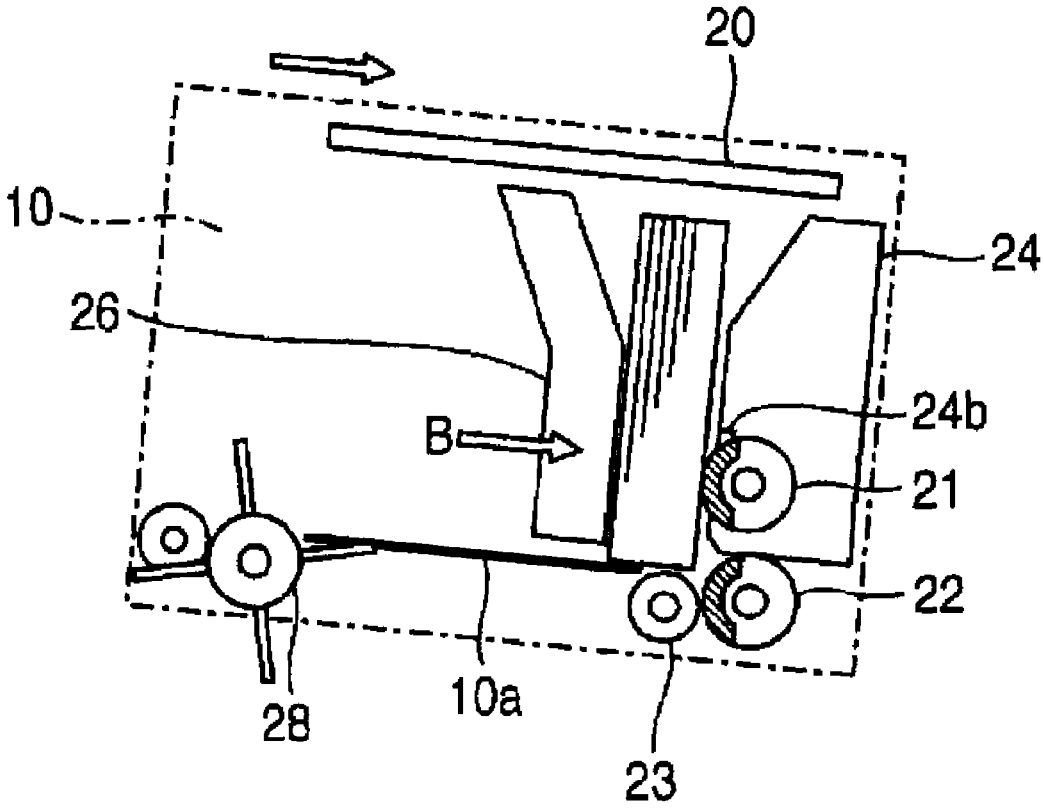
FIG. 6 is an explanatory view showing a bill deposit/withdrawal unit that performs a bill delivery operation.

Here, FIG. 6 is an explanatory view showing the bill deposit/withdrawal unit that performs delivery operation of bills.

After the shutter 20 is closed, in order to perform separation and delivery operation of stored bills, the bill press 26 is moved toward the bill guide portion 24. Moreover, the bills in the receiving space are pinched in an upright state by the bill guide portion 24 and the bill press 26, and the bill guide portion 25 and the bill press 26 are moved toward the pickup roller 21 as is. Thereby, as shown in FIG. 6, the pickup roller 21 protrudes into the receiving space from the cutout hole 24*b* of the bill guide portion 24, and abuts on the bills received in an upright state.

Figure 7:
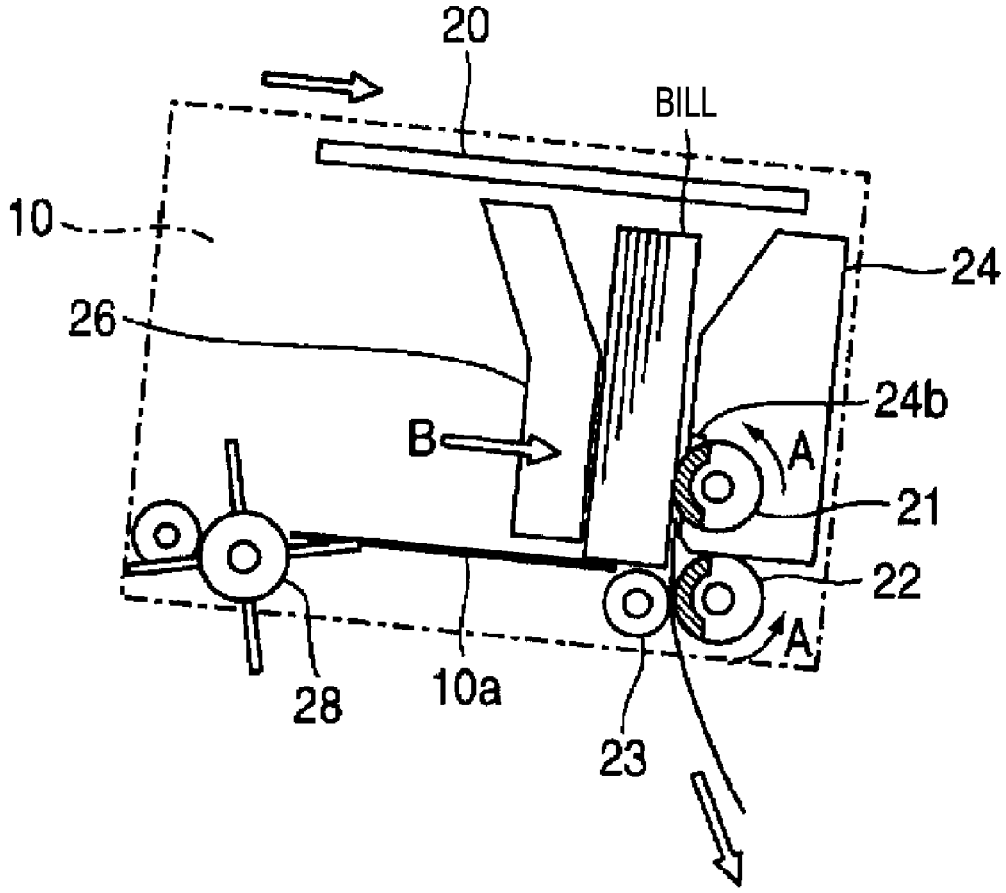
FIG. 7 is an explanatory view showing a state in which bills are delivered.

FIG. 7 is an explanatory view showing that bills are delivered.

The pickup roller 21 and a feed roller 22 rotate in the delivery direction of bills. That is, as the pickup roller 21 and the feed roller 22 rotate in the direction of an arrow A shown in FIG. 7, a bill that abuts on the pickup roller 21 is delivered to between the feed roller 22 and the gate roller 23. Moreover, the bills are separated one by one between the feed roller 22 and the gate roller 23, and are delivered to the above-described conveying path 13, and the bills are discriminated in the bill discrimination unit 14. Additionally, according to the result of the discrimination, the bills are stored in each storage of the bill storage section 15, thereby performing deposit processing.

Figure 8:
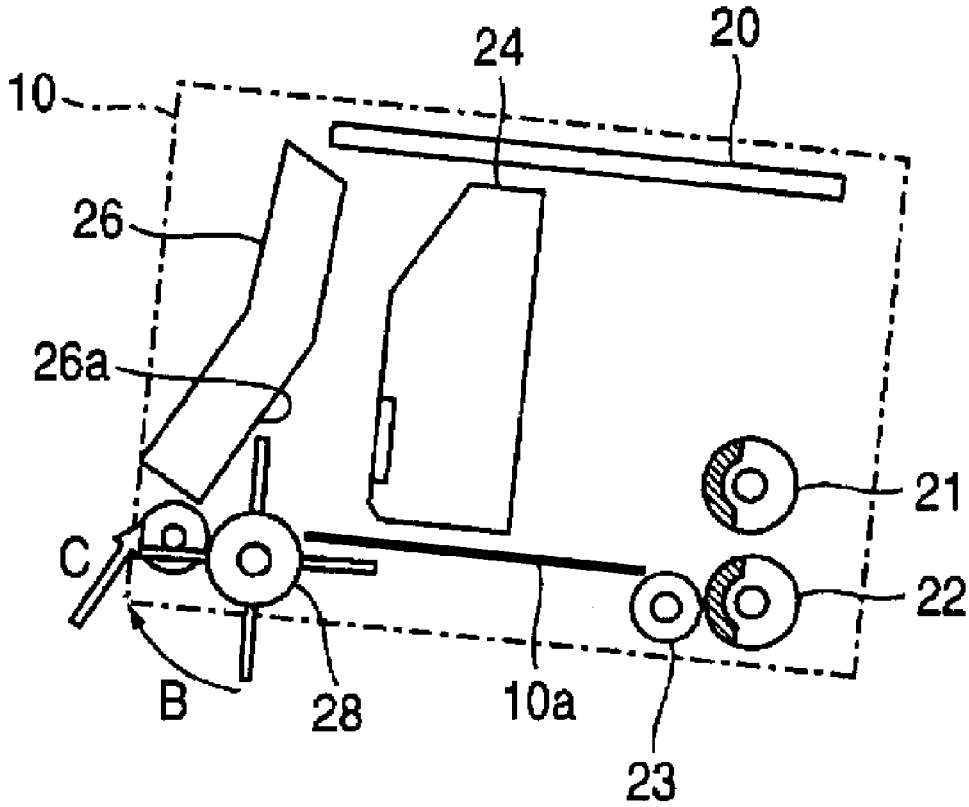
FIG. 8 is an explanatory view showing the bill deposit/withdrawal unit when the bills to be paid out to a customer are accumulated.

Here, FIG. 8 is an explanatory view showing the bill deposit/withdrawal unit when the bills to be paid out to a customer are accumulated.

In addition, in a case where input-rejected bills have been generated, the input-rejected bills are temporarily stored in a rejected bill temporary storage unit 17, and all input bills are delivered. Thereafter, as shown in FIG. 8, the bill press 26 is moved to above the accumulating tongue piece roller 28. Moreover, the bill guide portion 24 is moved toward the accumulating tongue piece roller 28, and the bill guide portion 24 is located in a place distant at a predetermined gap from the bill press 26.

At this time, since the bill press 26 that has moved to above the accumulating tongue piece roller 28 is brought into an inclined state, the supporting face 26*a* is brought into the state of being inclined toward the accumulating tongue piece roller 28 from the state of being parallel to the bill face.

Then, the accumulating tongue piece roller 28 is rotated in the direction of an arrow B shown in FIG. 8, and the input-rejected bills are conveyed from the rejected bill temporary storage unit 17 to the bill deposit/withdrawal unit 10 by the conveying path 13.

The input-rejected bills that are conveyed in this way enter the bill deposit/withdrawal unit 10 in the direction of an arrow C shown in FIG. 8.

Figure 9:
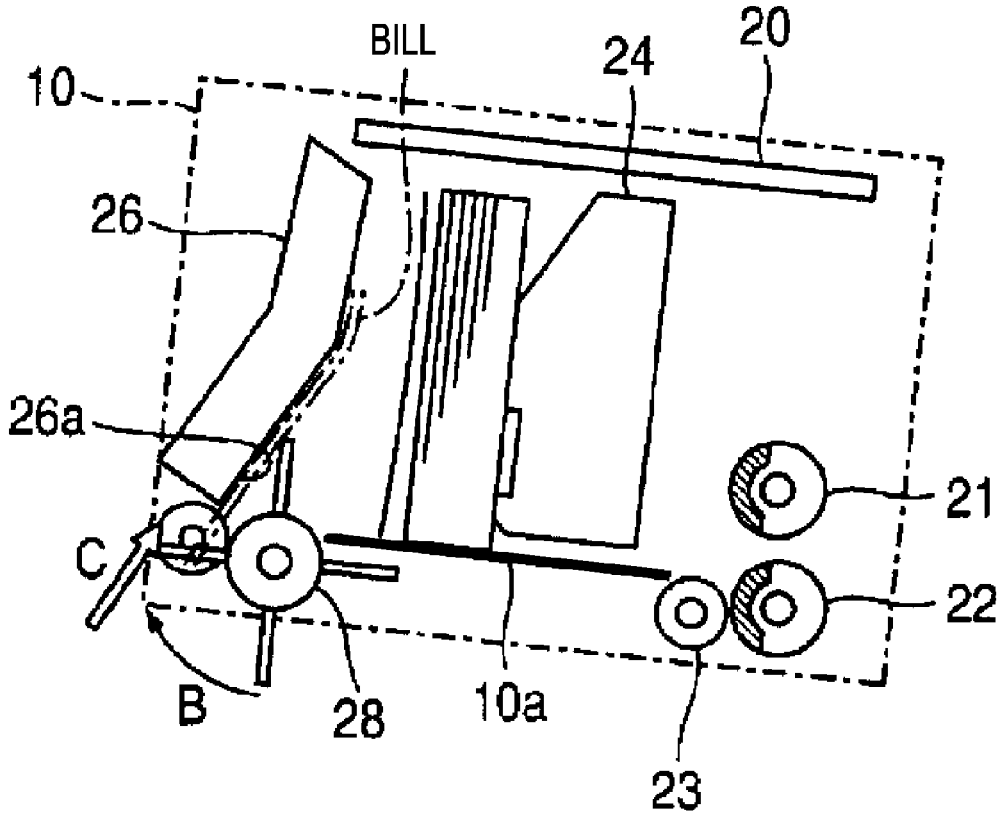
FIG. 9 is an explanatory view showing a state in which the bills to be paid out to a customer are accumulated.
Figure 10:
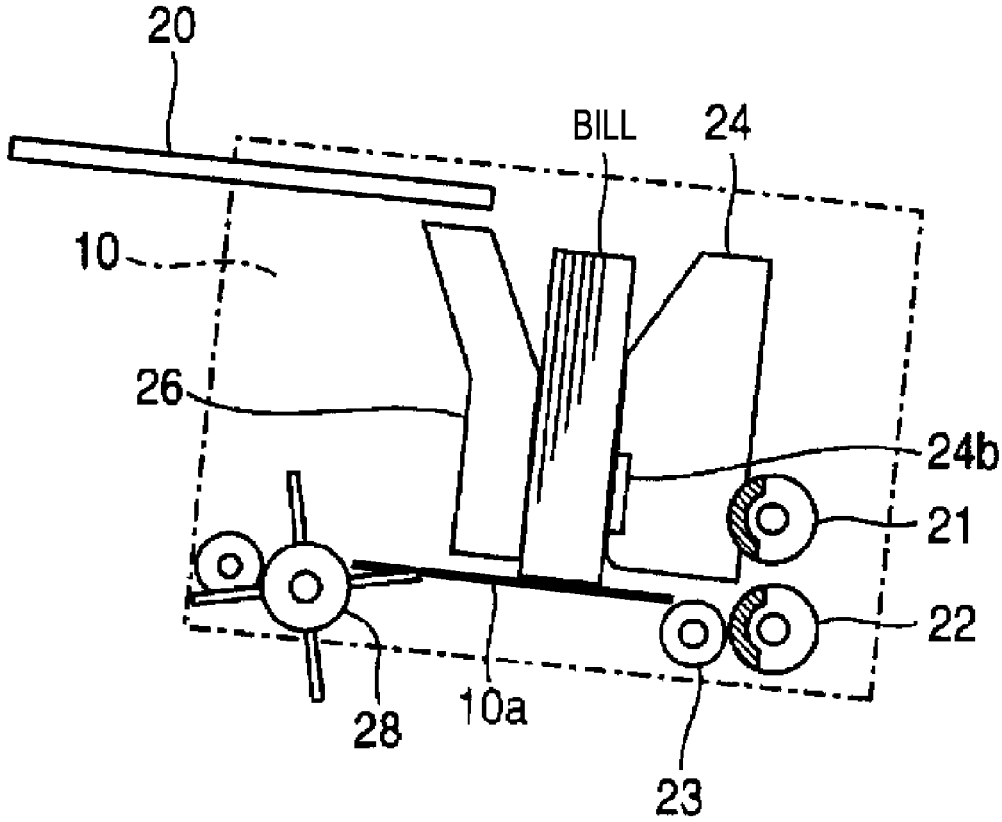
FIG. 10 is an explanatory view showing a state in which a shutter has been opened in order to pay out bills to a customer.

FIG. 9 is an explanatory view showing that the bills to be paid out to a customer are accumulated, and FIG. 10 is an explanatory view showing that the shutter has been opened in order to pay out bills to a customer.

The input-rejected bills that enter the bill deposit/withdrawal unit 10, as are shown in FIG. 9, enter the bill deposit/withdrawal unit 10 along the supporting face 26*a* of the bill press 26, are tapped toward the bill guide portion 24 side by the accumulating tongue piece roller 28, and are accumulated along the bill guide portion 24.

After all the input-rejected bills are accumulated, the bill press 26 is moved toward the bill guide portion 24, and the bill press 26 is made to abut on the input-rejected bills. Next, the bill guide portion 24 and the bill press 26 are moved toward the pickup roller 21. Thereby, the input-rejected bills are moved to a place where a customer can easily take the input-rejected bills, when the shutter 20 has been opened. Then, after the input-rejected bills are moved, as shown in FIG. 10, the shutter 20 is opened, and the input-rejected bills are returned to the customer.

At this time, the stop position of the bill press 26 is determined in advance, the bill press 26 is moved to the stop position, and the bill guide portion 24 are also moved correspondingly.

Next, a case where withdrawal processing is performed will be described.

In a case where withdrawal processing is performed, the bill press 26 is moved to above the accumulating tongue piece roller 28. Moreover, the bill guide portion 24 is moved toward the accumulating tongue piece roller 28, and is located in a place distant at a predetermined gap from the bill press 26.

At this time, the bill press 26 that has been moved to above the accumulating tongue piece roller 28 is brought into an inclined state. Thereby, the supporting face 26*a* of the bill press 26 is brought into the state of being inclined toward the accumulating tongue piece roller 28 from the state of being parallel to the bill face.

Then, the accumulating tongue piece roller 28 is rotated in the direction of the arrow B shown in FIG. 8, the bills to be withdrawn are delivered from the bill storage section 15, and the bills are conveyed to the bill deposit/withdrawal unit 10 by the conveying path 13. The bills that are conveyed in this way enter the bill deposit/withdrawal unit 10 in the direction of the arrow C shown in FIG. 8.

The bills that enter the bill deposit/withdrawal unit 10, as shown in FIG. 9, enter the bill deposit/withdrawal unit 10 along the supporting face 26*a* of the bill press 26. Then, the bills are tapped toward the bill guide portion 24 by the accumulating tongue piece roller 28, and are accumulated along the bill guide portion 24.

After all the bills are accumulated, the bill press 26 is moved toward the bill guide portion 24, and is made to abut on the bills. Next, the bill guide portion 24 and the bill press 26 are moved toward the pickup roller 21. Thereby, when the shutter 20 has been opened, the bills are moved to a place where a customer can easily take the bills, and then the shutter is opened to allow the customer to withdraw the bills.

As described above, in the present embodiment, the supporting face of the bill press that has been moved to above the accumulating tongue piece roller is inclined toward the accumulating tongue piece roller. Then, when the bills to be paid out to a customer are conveyed to the bill deposit/withdrawal unit, the bills enter the bill deposit/withdrawal unit along the supporting face of the bill press that has been moved to above the accumulating tongue piece roller, and are accumulated in an upright state along the bill guide portion. Moreover, the accumulated bills are pinched between the bill press and the bill guide portion, and are paid out to a customer. Thereby, the bills to be paid out to a customer can be prevented from falling during the accumulation thereof, and the bills can be stably accumulated.

Additionally, unlike in the conventional technique, it is not necessary to provide one of two bill presses, a tilting mechanism for the bill press, a retreating mechanism for a rejected bill stopper, and the like, and these can be omitted to form a simple mechanism. Therefore, the number of parts becomes fewer and the manufacturing costs can be reduced.

Embodiment 2

The present embodiment is different from the above Embodiment 1 in that a portion of the bottom plate of the bill deposit/withdrawal unit is formed as the bill raising unit, and an escape portion in which an upper end of a portion of the sliding groove is widened.

Figure 11:
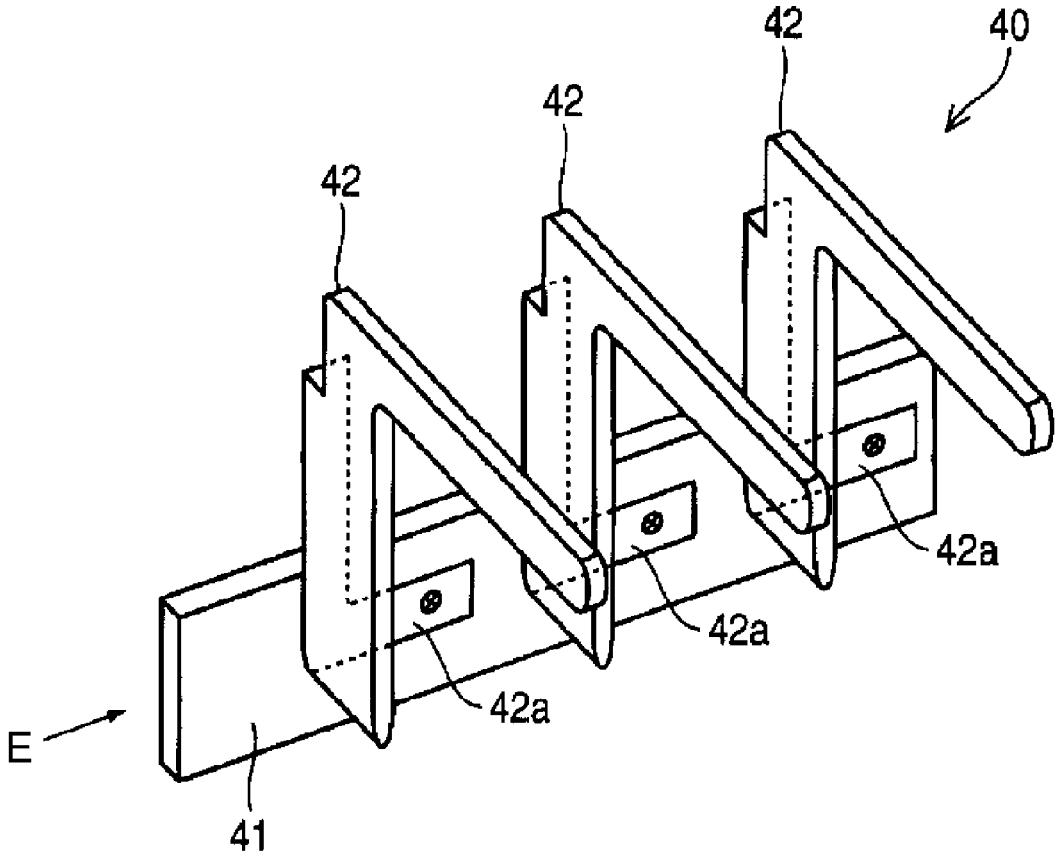
FIG. 11 is a perspective view showing a bill raising unit of embodiment 2.

FIG. 11 is a perspective view showing the bill raising unit of Embodiment 2.

In FIG. 11, reference numeral 40 designates a bill raising unit in which plural bill supporting sections 42 are fixed to the attachment plate 41 and that is configured so as to be capable of moving up and down by an elevating mechanism (not shown). Typically, an upper portion of each bill supporting section 42 is brought into the state of having moved down so as to be substantially flush with the bottom plate 10*a*, and the upper portion of the bill supporting section 42 operates so as to move up when bills are paid out to a customer.

In the bill supporting section 42, the shape as seen from the side, i.e., the shape as seen from the direction of an arrow E shown in FIG. 11 is an L-shape in which up and down directions are inverted. Moreover, the bill supporting section 42 has a fixed face 42*a* that is a face parallel to the attachment plate 41 as seen from the front and is provided with a screw hole. Thereby, the bill supporting section 42 is fixed to the attachment plate 41 by tightening the fixed face 42*a* and the attachment plate 41 in an overlapping manner with screws.

The fixed face 42*a* of the bill supporting sections 42 is fixed to the attachment plate 41 by screw retaining, and plural bill supporting sections are attached along the longitudinal direction of the attachment plate 41.

In addition, the bill guide portion 24 and the bill press 26 are provided with cutouts that prevent contact with the bill raising unit 40 that is moving up.

Figure 12:
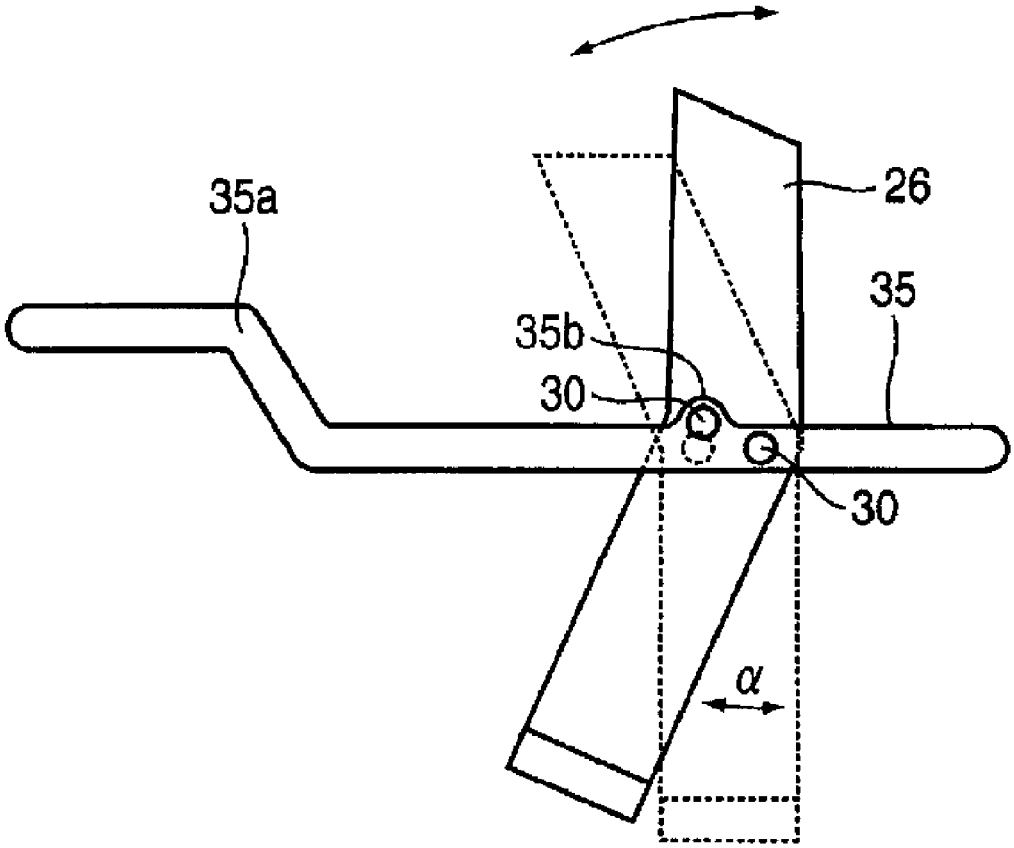
FIG. 12 is an explanatory view showing the shape of a sliding groove of embodiment 2.

FIG. 12 is an explanatory view showing the shape of a sliding groove of Embodiment 2.

In FIG. 12, reference numeral 35*b* designates an escape portion that is provided at a position at which the sliding pin 30 on the side of the accumulating tongue piece roller 28 of the bill press 26 has stopped when the shutter 20 is opened to pay out bills to a customer. Then, the escape portion 35*b* is formed such that the width thereof is partially increased so that the sliding pins 30 by the side of the accumulating tongue piece roller 28 can escape from the bottom plate 10*a* side.

Additionally, in the present embodiment, a pressing means (not shown) is provided to press and turn the bill press 26 so that the sliding pin 30 on the side of the accumulating tongue piece roller 28 enters the escape portion 35*b* when bills are paid out. This pressing means is, for example, a solenoid that is arranged, for example, between the bill press 26 and the bill guide portion 24 at a position where the solenoid does not come into contact with any bill. Also, when the bill press 26 has moved and stopped at a position when bills are paid out, an electric current is applied to the solenoid, thereby extending an internal plunger, and turning of the bill press 26 is realized, for example, by pressing the supporting face 26*a*.

The operation after the bills to be paid out to a customer by the withdrawal processing are accumulated in the bill deposit/withdrawal unit in the above-described configuration will be described.

In addition, the operation until bills are conveyed to and accumulated in the bill deposit/withdrawal unit 10 is the same as that of the above Embodiment 1. That is, after all the bills are accumulated, the bill press 26 is moved toward the bill guide portion 24 and is made to abut on the bills, and both the bill guide portion 24 and the bill press 26 are moved toward the pickup roller 21.

Figure 13:
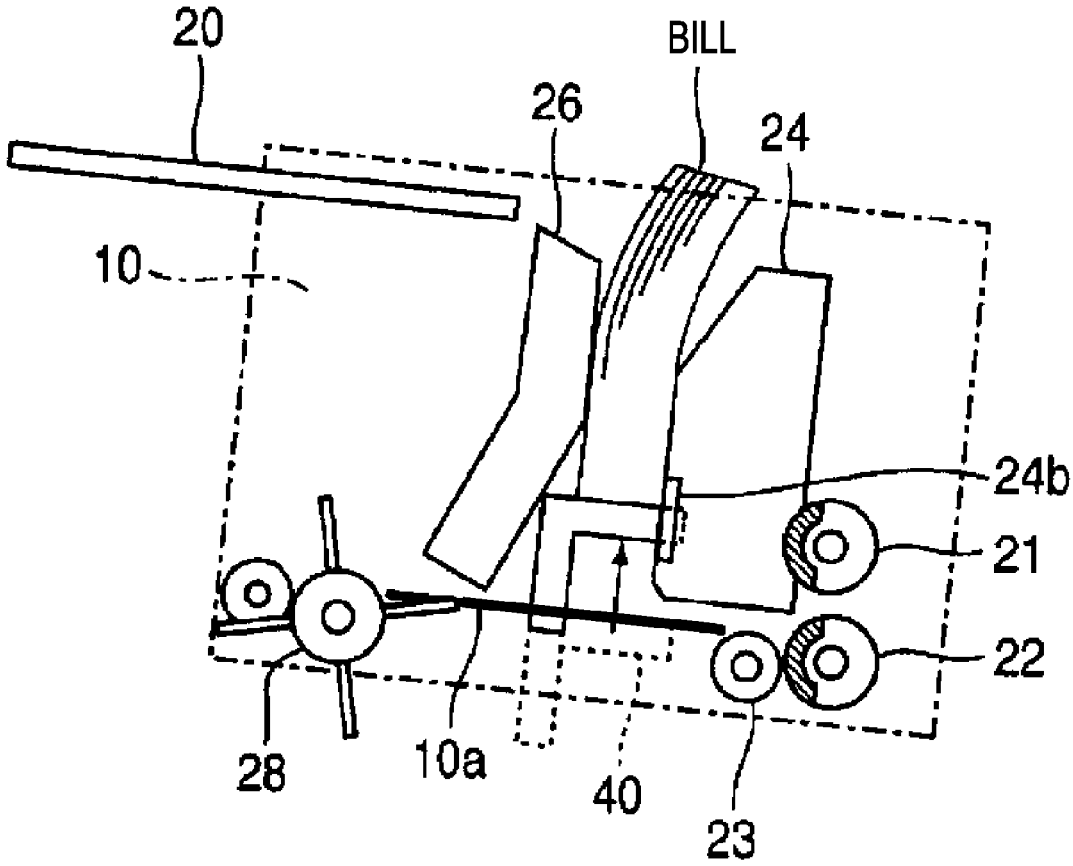
FIG. 13 is an explanatory view showing a bill deposit/withdrawal unit that pays out bills in embodiment 2.

Here, FIG. 13 is an explanatory view showing the bill deposit/withdrawal unit that pays out bills of Embodiment 2.

Also, the bill press 26 is stopped at a position when bills are paid out, and the bill guide portion 24 is stopped accordingly. Moreover, when the shutter 20 has been opened, the bills are moved to a place where a customer can easily take the bills. After the bills are moved, the bill press 26 is turned at angle of $\alpha$ so that the sliding pin 30 on the side of the accumulating tongue piece roller 28 shown in FIG. 12 enters the escape portion 35*b*, while the bill raising unit 40 is raised. Then, as shown in FIG. 13, the inclined face 26*b* is made to face the bill guide portion 24, and the shutter 20 is opened.

Therefore, when the bills accumulated in the bill raising unit 40 are lifted, the contact area between the bills and the bill guide portion 24 or the bill press 26 decreases. However, as of the bill press 26 turns simultaneously, the inclined face 26*b* of the bill press 26 becomes substantially parallel to the bill face newly. Thus, it is possible to suppress a situation in which the upright state of the bills is collapsed with the ascent thereof and the bills are inclined toward the bill press 26.

As described above, in the present embodiment, bills are raised by the bill raising unit in addition to the effects of the above Embodiment 1. Thereby, a customer whose visual line is low, for example, a customer who is in a wheelchair, uses a bill deposit/withdrawal machine, such as an automatic teller machine, and the customer more easily views bills, such as bills to be paid out during withdrawal or input-rejected bills returned during deposit. Since the bills are easily viewed, the effect by which forgetting to take bills can be prevented is acquired.

EXPLANATION OF REFERENCES

1: AUTOMATIC TELLER MACHINE
2: DISPLAY OPERATION UNIT
3: CARD READ/WRITE UNIT
4: BANKBOOK HANDLING UNIT
5: CASH DEPOSIT/WITHDRAWAL UNIT
5*a*: BILL DEPOSIT/WITHDRAWAL PORT
5*b*: COIN WITHDRAWAL PORT
10: BILL DEPOSIT/WITHDRAWAL UNIT
10*a*: BOTTOM PLATE
13: CONVEYING PATH
14: BILL DISCRIMINATION UNIT
15: BILL STORAGE SECTION
16: BILL RECOVERY UNIT
16*a*: RECOVERED BILL STORAGE
16*b*: FORGOTTEN BILL RECOVERY STORAGE
17: REJECTED BILL TEMPORARY STORAGE UNIT
20: SHUTTER
21: PICKUP ROLLER
22: FEED ROLLER
23: GATE ROLLER
24: BILL GUIDE PORTION
24*a*: BILL ABUTTING FACE
24*b*: CUTOUT HOLE
26: BILL PRESS
26*a*: SUPPORTING FACE
26*b*: INCLINED FACE
28: ACCUMULATED TONGUE ROLLER
30: SLIDING PIN
31: DETECTION PLATE
33: POSITION SENSOR
35: SLIDING GROOVE
35*a*: BENT PORTION
40: BILL RAISING UNIT
41: ATTACHMENT PLATE
42: BILL SUPPORTING SECTION
42*a*: FIXED FACE
35*b*: ESCAPE PORTION

The invention claimed is:

1. A bill deposit/withdrawal machine comprising:

a separation/delivery assembly that delivers bills, which are input into a bill deposit/withdrawal unit, to a conveying path;

an accumulating tongue piece roller that accumulates the bills to be paid out to a customer in the bill deposit/withdrawal unit;

a bill guide portion and a bill press that are arranged to face each other and reciprocate between the separation/delivery assembly and the accumulating tongue piece roller; and a temporary storage unit that temporarily stores input-rejected bills to be returned to a customer, from among the bills input by the customer;

wherein the bill press has a dog-leg shape composed of a supporting face facing the bills and an inclined face inclined in a direction away from the bills above the supporting face;

wherein when the bills are accumulated in the bill deposit/withdrawal unit, and a turning element is provided to turn the bill press so that the supporting face of the bill press moved toward the accumulating tongue piece roller is inclined to guide the bills toward the bill guide portion;

wherein in the bill deposit/withdrawal machine, the separation/delivery assembly delivers bills, which are input into the bill deposit/withdrawal unit, to the conveying path, and, in a case where input-rejected bills have been generated, the input-rejected bills are temporarily stored in the temporary storage unit; and wherein after the input bills are delivered, the bill press is moved to a side of the accumulating tongue piece roller, and the turning element turns the bill press so that the supporting face of the bill press is inclined to guide the bills toward a side of the bill guide portion, thereby accumulating the input-rejected bills.

2. A bill deposit/withdrawal machine comprising:

a separation/delivery assembly that delivers bills, which are input into a bill deposit/withdrawal unit, to a conveying path;

an accumulating tongue piece roller that accumulates the bills to be paid out to a customer in the bill deposit/withdrawal unit; and a bill guide portion and a bill press that are arranged to face each other and reciprocate between the separation/delivery assembly and the accumulating tongue piece roller;

wherein the bill press has a dog-leg shape composed of a supporting face facing the bills and an inclined face inclined in a direction away from the bills above the supporting face;

wherein when the bills are accumulated in the bill deposit/withdrawal unit, and a turning element is provided to turn the bill press so that the supporting face of the bill press moved toward the accumulating tongue piece roller is inclined to guide the bills toward the bill guide portion;

wherein the bill press has two pins lined up along a movement direction on a side face of the billpress;

wherein a sliding groove into which the pins are slidably fitted is provided at the side of the bill press, and a bent portion inclined in a direction away from the accumulating tongue piece roller is provided at one end of the sliding groove on a side of the accumulating tongue piece roller and is used as the turning element; and wherein, when the bills to be paid out to a customer are accumulated in the bill deposit/withdrawal unit, the bill press turns so that the pin on the side of the accumulating tongue piece roller enters the bent portion, and the supporting face is thereby inclined toward the accumulating tongue piece roller.

3. The bill deposit/withdrawal machine according to claim 2, wherein:

an escape portion, which escapes in a direction in which a pin separates from a bottom plate of the bill deposit/withdrawal unit, is formed in the sliding groove at a stop position of the one of the two pins that is located on the side of the accumulating tongue piece roller when bills are paid out to a customer;

a pressing assembly that presses the supporting face and turns the bill press, and a raising portion that raises the bills accumulated in the bill deposit/withdrawal unit are provided; and the accumulated bills are raised by the raising portion when the bills accumulated in the bill deposit/withdrawal unit are paid out, and at this time, the supporting face is pressed by the pressing assembly to turn the bill press to make the inclined face face parallel to the bill guide portion so that the pin on the side of the accumulating tongue piece roller escapes to the escape portion.

* * * * *